US006307354B1

(12) United States Patent
Nishihira et al.

(10) Patent No.: US 6,307,354 B1
(45) Date of Patent: Oct. 23, 2001

(54) APPARATUS AND METHOD FOR LIMITING LEAKAGE TO GROUND CURRENT WHILE OPTIMIZING OUTPUT OF A POWER SUPPLY ADAPTABLE FOR USE WITH A MOTION SENSOR SWITCH

(75) Inventors: Thomas S. Nishihira, Newark; David A. Blau, Cupertino, both of CA (US); John R. Baldwin, Newton, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/497,336

(22) Filed: Feb. 3, 2000

Related U.S. Application Data

(63) Continuation-in-part of application No. 09/467,375, filed on Dec. 21, 1999, now abandoned, which is a continuation-in-part of application No. 09/340,112, filed on Jun. 28, 1999, now abandoned.

(51) Int. Cl.[7] ..... G05F 1/40

(52) U.S. Cl. ..... 323/269; 323/350; 340/540; 369/170

(58) Field of Search ..... 307/116; 369/170; 700/12; 340/540; 327/439, 463; 323/278, 269, 909, 350; 363/127, 125

(56) References Cited

U.S. PATENT DOCUMENTS

| | | | | |
|---|---|---|---|---|
| 2,967,991 | * | 1/1961 | Deuitch | 323/278 |
| 3,769,572 | * | 10/1973 | Doubt | 323/315 |
| 4,333,138 | * | 6/1982 | Huber | 363/89 |
| 4,347,561 | * | 8/1982 | McLellan | 363/45 |
| 4,874,962 | | 10/1989 | Hermans . | |
| 5,619,185 | | 4/1997 | Ferraro . | |
| 5,699,243 | | 12/1997 | Eckel et al. . | |
| 5,763,872 | | 6/1998 | Ness . | |
| 5,777,837 | | 7/1998 | Eckel et al. . | |
| 5,821,642 | | 10/1998 | Nishihira et al. . | |
| 5,856,905 | | 1/1999 | Eckel et al. . | |
| 5,867,099 | | 2/1999 | Keeter . | |
| 5,946,209 | | 8/1999 | Eckel et al. . | |
| 5,971,597 | | 10/1999 | Baldwin et al. . | |
| 5,984,513 | | 11/1999 | Baldwin . | |

* cited by examiner

*Primary Examiner*—Shawn Riley
(74) *Attorney, Agent, or Firm*—Mark S. Bicks; Alfred N. Goodman

(57) ABSTRACT

A method and apparatus for regulating a DC power supply, adaptable for use with a motion sensor switch, by limiting the leakage to ground current of the power supply to comply with U.L. Standards while also enabling the DC power supply to provide a stable DC output voltage which is essentially unaffected by changes in magnitude of the AC supply voltage or changes in ambient temperature. The method and apparatus employs first and second transistors, in which the base and collector of the first transistor and the base and collector of the second transistor are coupled to receive a voltage based on the AC supply voltage, and the emitter of both the first and second transistors are coupled to drive an output circuit of the DC power supply. The emitter of the second transistor is also coupled via a first resistor to the base of the first transistor, and the collector of the second transistor is also coupled via a second resistor to the base of the first transistor. The magnitudes of the first and second resistors are determined such that the leakage to ground current remains substantially constant over a range of magnitudes of the AC supply voltage, and the emitters of the first and second transistors drive the output circuit to provide at a plurality of output terminals a plurality of stable DC output voltages having respective magnitudes which are essentially unaffected by changes in the magnitude of the AC supply voltage. A zener diode can be coupled between the emitters of the first and second transistors to cause the magnitudes of the stable DC output voltages to be essentially unaffected by changes in temperature.

22 Claims, 9 Drawing Sheets

APPARATUS AND METHOD FOR LIMITING LEAKAGE TO GROUND CURRENT WHILE OPTIMIZING OUTPUT OF A POWER SUPPLY ADAPTABLE FOR USE WITH A MOTION SENSOR SWITCH

This is a continuation-in-part of U.S. patent application Ser. No. 09/467,375, filed on Dec. 21, 1999, now abandoned which is a continuation-in-part of U.S. patent application Ser. No. 09/340,112, filed on Jun. 28, 1999, now abandoned the entire contents of both being incorporated by reference herein.

CROSS-REFERENCE TO RELATED APPLICATIONS

Related subject matter is disclosed in a copending U.S. patent application of Thomas S. Nishihira and David A. Blau entitled "Apparatus and Method for Providing Bypass Functions for a Motion Sensor Switch", Ser. No. 09/340,150, and in a copending U.S. patent application of Thomas S. Nishihira and David A. Blau entitled "Bi-Color Indicator Lamp for Room Occupancy Sensor", Ser. No. 09/340,113, both applications filed on Jun. 28, 1999, and the entire contents of each being incorporated herein by reference.

BACKGROUND OF THE INVENTION

1. Field of the Invention

The present invention relates to an apparatus and method for limiting the leakage to ground current while optimizing output of a power supply adaptable for use with a motion sensor switch. More particularly, the present invention relates to an apparatus and method for employing in a power supply a regulator comprising a transistor and resistor arrangement which limits leakage to ground current of the power supply and optimizes output of the power supply for a range of input voltages.

2. Description of the Related Art

Motion sensor switches, such as Model 1WS-ZP-M and Model 1WS-ZP-277V motion sensor switches manufactured by Hubbell, Inc., include a motion sensor, such as a passive infrared detector (PIR), and an ambient light level sensor, such as a photocell. Other motion sensor switches are described in U.S. Pat. No. 5,821,642 to Nishihira et al., U.S. Pat. No. 5,699,243 to Eckel et al., and U.S. Pat. No. 4,874,962 to Hermans, the entire contents of each being incorporated herein by reference.

Motion sensor switches of this type can be used, for example, as an occupancy detector which shuts off lights in a room when the sensor detects that no one is present in the room, and turns on the lights in the room when a person enters the room. A motion sensor switch also can be used, for example, as a motion sensor for an alarm system.

During operation, the motion sensor of the motion sensor switch monitors an area, such as an office, conference room in a building, or a home, for the presence of movement. Specifically, the motion sensor detects a change in the infrared energy radiating from regions in the area monitored by different sensing lobes of the PIR detector, which generally have a pass band within the 8–14 $\mu$m infrared range. If a person enters the monitored area, the person changes the amount of infrared energy being detected by the PIR detector. Therefore, the magnitude of the signal output by PIR detector, which is representative of the amount of detected infrared energy, will change. A motion sensor circuit in the motion sensor switch processes this signal, and provides a signal to a controller indicating that the amount of infrared energy received by the infrared detector has changed.

The controller interprets the signal provided by the motion sensor circuit, along with the signal provided by ambient light level sensor. If the signal provided by ambient light level sensor indicates that the ambient light in the monitored area is low (e.g., very little natural light is present in the monitored area), the control circuit will turn on or increase the brightness of the lights in the monitored area. However, if the signal provided by ambient light level sensor indicates that the ambient light in the monitored area is sufficient (e.g., due to sunlight, etc.), the control circuit may not turn on or brighten the lights, or may only brighten the lights slightly. In either event, control of the lights is based on the signals provided by the motion sensor and ambient light level sensor.

Motion sensor switches of this type also typically include a delay timing adjustment device, such as a potentiometer, which can be manually adjusted to set the delay time during which the lights should remain on after all occupants have left the monitored area. For example, if the delay timing adjustment device is adjusted to a 30-second setting, when all occupants leave and remain out of the monitored area for a period of time exceeding 30 seconds, the circuit of the motion sensor turns off the lighting load in the monitored area to conserve energy.

Motion sensor switches of the type described above are typically powered by a power supply circuit which receives an AC supply voltage, such as 110 VAC or 277 VAC, and converts the AC supply voltage into DC voltages of suitable levels, for example, +3 VDC, +6 VDC and +28 VDC for driving respective components of the motion sensor switch. Examples of power supply circuits are described in U.S. Pat. No. 4,874,962 to Hermans and U.S. Pat. No. 5,821,642 to Nishihira et al., cited above.

As described in these patents, the DC voltages are generated from a "leakage to ground current" that flows from the hot terminal of the AC supply voltage through, for example, a resistive element to earth ground. Specifically, the leakage to ground current generates an AC voltage across the resistive element, which is provided to a rectifier circuit, for example, that establishes a DC voltage of suitable magnitude (e.g., +28 VDC) at a power supply output terminal. Also, voltage divider circuits are coupled to the output terminal which further reduce the magnitude of the DC voltage to other desired magnitudes (e.g., +6 VDC and +3 VDC).

As further described in U.S. Pat. No. 4,874,962, in particular, U.L. Standards require that the leakage to ground current be limited to no greater than 500 $\mu$A RMS in these types of power supplies which are used in commercial settings such as buildings and the like. To achieve this current limiting feature, the circuit described in U.S. Pat. No. 4,874,962 includes two resistors and a neon lamp coupled in series between the hot terminal of the AC supply voltage and the rectifier circuit that establishes the DC voltage.

On the other hand, the circuit described in U.S. Pat. No. 5,821,642 uses resistors having different magnitude resistance values depending on the magnitude of AC supply voltages of different magnitudes to limit the leakage to ground current in the power supply to less than 500 $\mu$A RMS to comply with U.L. Standards. That is, for a 110 VAC supply voltage, the power supply uses a 226 kΩ resistor to limit the leakage to ground current to less than 500 $\mu$A RMS. However, for a 277 VAC supply voltage, the power supply uses a 549 kΩ resistor to limit the leakage to ground current to less than 500 $\mu$A RMS.

Although the types of resistive current regulators used in the power supplies described above are generally suitable to limit the leakage to ground current to comply with U.L Standards, those types of current limiters have certain drawbacks. In particular, the magnitude of current passing through these current regulators varies in proportion to a change in AC supply voltage. For example, if the AC supply voltage doubles, the magnitude of current passing through the current regulator also essentially doubles. Because this current is used to generate the DC output voltage of the power supply as described above, any fluctuation in current magnitude will cause a proportional fluctuation in the magnitude of the DC output voltage. Accordingly, the stability of the DC output voltage of power supplies including these resistive current regulators is largely dependent on the stability of the AC supply voltage.

Another type of regulator circuit 10 that can be used in the power supply circuits described above in place of the resistive regulator circuit is shown in FIG. 1. As illustrated, the regulator circuit 10 includes a plurality of NPN transistors 12 and 14 which are coupled to reduce fluctuations in leakage to ground current caused by fluctuations in the magnitude of the AC supply voltage, while also limiting the maximum value of the leakage to ground current to comply with U.L. Standards.

Specifically, in this arrangement, the collector of transistor 12 is coupled to the hot terminal of the AC supply voltage, and the base of this transistor 12 is coupled via a resistor 16 to the hot terminal. The emitter of this transistor 12 is coupled to the base of transistor 14, and is further coupled via a resistor 18 to the output terminal of the regulator circuit. The collector of transistor 14 is coupled to the base of the first transistor 102, and is further coupled via resistor 16 the to the hot terminal of the AC supply voltage. The emitter of transistor 14 is coupled to the output terminal of the regulator circuit.

The regulator circuit shown in FIG. 1 is more capable than the resistor regulator circuit of maintaining a stable leakage to ground current in response to a fluctuation in the magnitude of the AC supply voltage. However, this type of regulator circuit still allows for a significant fluctuation in the magnitude of the leakage current to ground in response to fluctuations in the AC supply voltage, as well as in response to changes in temperature. Hence, the stability of the DC output voltage of a power supply circuit including this type of current regulator is still largely dependent on the stability of the AC supply voltage.

Accordingly, a continuing need exists for a regulator for a DC power supply that limits the leakage to ground current of the power supply to comply with U.L. Standards while also providing a stable DC output voltage which is virtually unaffected by changes in magnitude of the AC supply voltage and by changes in temperature, so that the power supply is suitable for providing power to, for example, a motion sensor switch.

SUMMARY OF THE INVENTION

An object of the present invention is to provide a regulator for a DC power supply, adaptable for use with a motion sensor switch, which limits the leakage to ground current of the power supply to comply with U.L. Standards while also providing a stable DC output voltage which is essentially unaffected by changes in magnitude of the AC supply voltage and by changes in temperature.

Another object of the present invention is to provide a regulator for a DC power supply which maintains the leakage to ground current of the power supply at a substantially constant level over a range of AC supply voltages being input to the power supply.

A further object of the present invention is to provide a DC power supply which converts an AC supply voltage into a stable DC output voltage having a magnitude independent of the magnitude of the AC supply voltage and changes in temperature.

These and other objects of the present invention are substantially achieved by providing a method and apparatus for regulating a DC power supply, adaptable for use with a motion sensor switch, by limiting the leakage to ground current of the power supply to comply with U.L. Standards while also enabling the DC power supply to provide a stable DC output voltage which is essentially unaffected by changes in magnitude of the AC supply voltage and by changes in temperature. The method and apparatus employs first and second transistors, in which the base and collector of the first transistor and the base and collector of the second transistor are coupled to receive a voltage based on the AC supply voltage, and the emitter of both the first and second transistors are coupled to drive an output circuit of the DC power supply. The emitter of the second transistor is also coupled via a first resistor to the base of the first transistor, and the collector of the second transistor is also coupled via a second resistor to the base of the first transistor. The magnitudes of the first and second resistors are determined such that the leakage to ground current remains substantially constant over a range of magnitudes of the AC supply voltage, and the emitters of the first and second transistors drive the output circuit to provide at a plurality of output terminals a plurality of stable DC output voltages having respective magnitudes which are essentially unaffected by changes in the magnitude of the AC supply voltage and by changes in temperature.

BRIEF DESCRIPTION OF THE DRAWINGS

These and other objects, advantages and novel features of the invention will be more readily appreciated from the following detail description when read in conjunction with the accompanying drawings, in which.

DETAILED DESCRIPTION OF THE PREFERRED EMBODIMENTS

Figures 1, 2A:
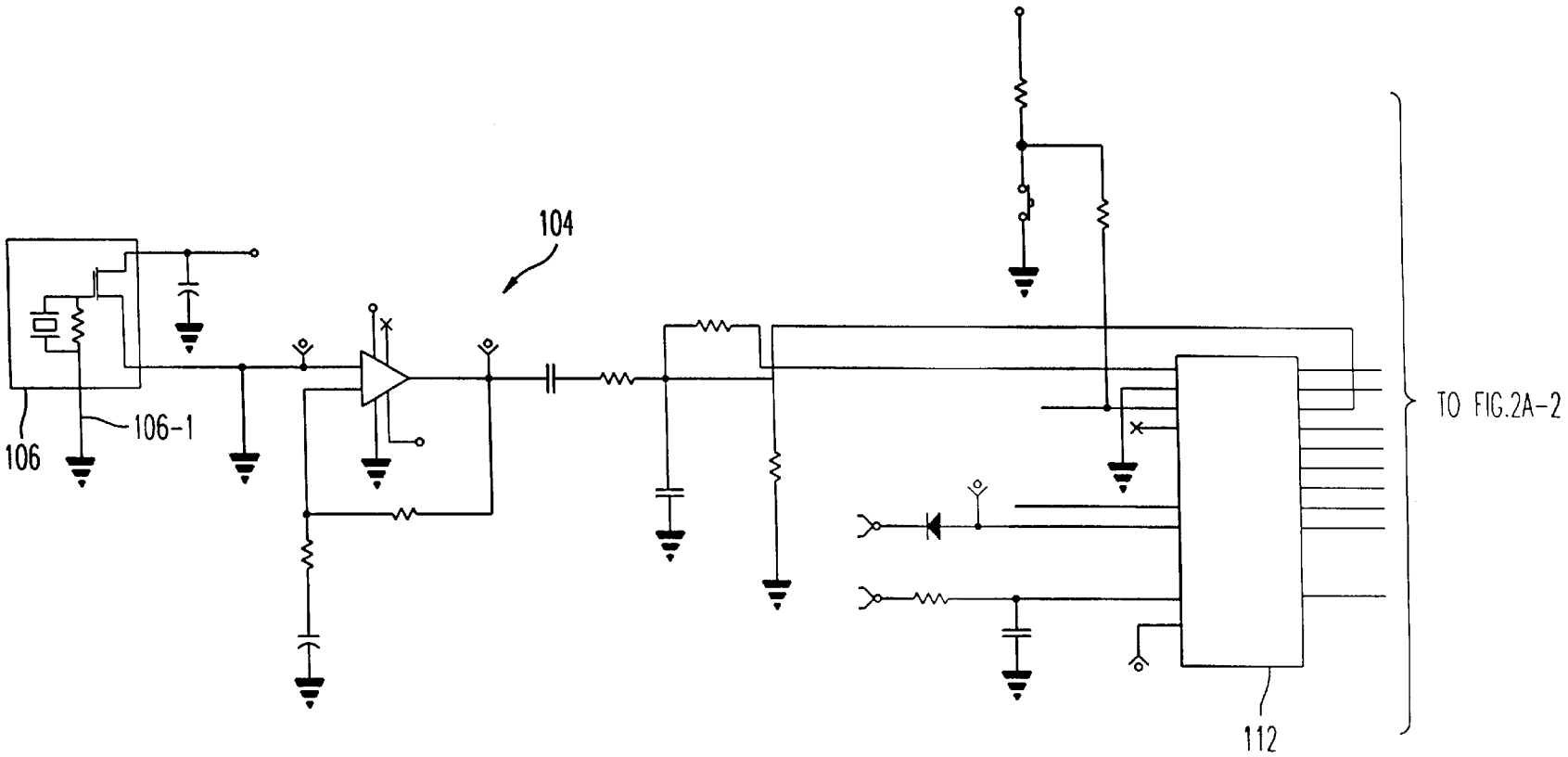
FIGS. 2A and 2B are schematic circuit diagrams of a motion sensor switch, and a DC power supply for providing a plurality of voltages to power the motion sensor switch and which includes a regulator according to an embodiment of the present invention.
Figures 2, 2A:
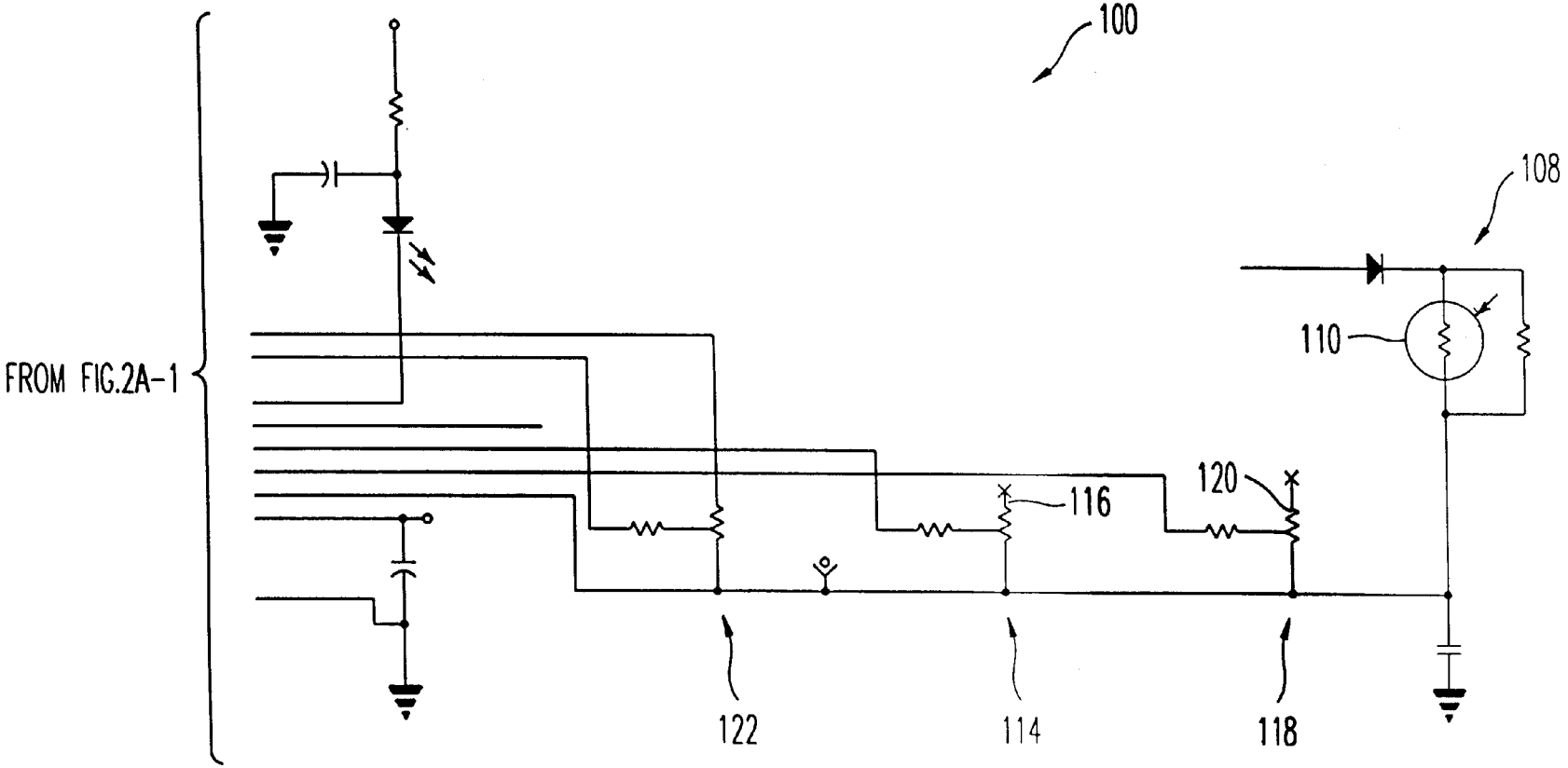
Figure 2B:
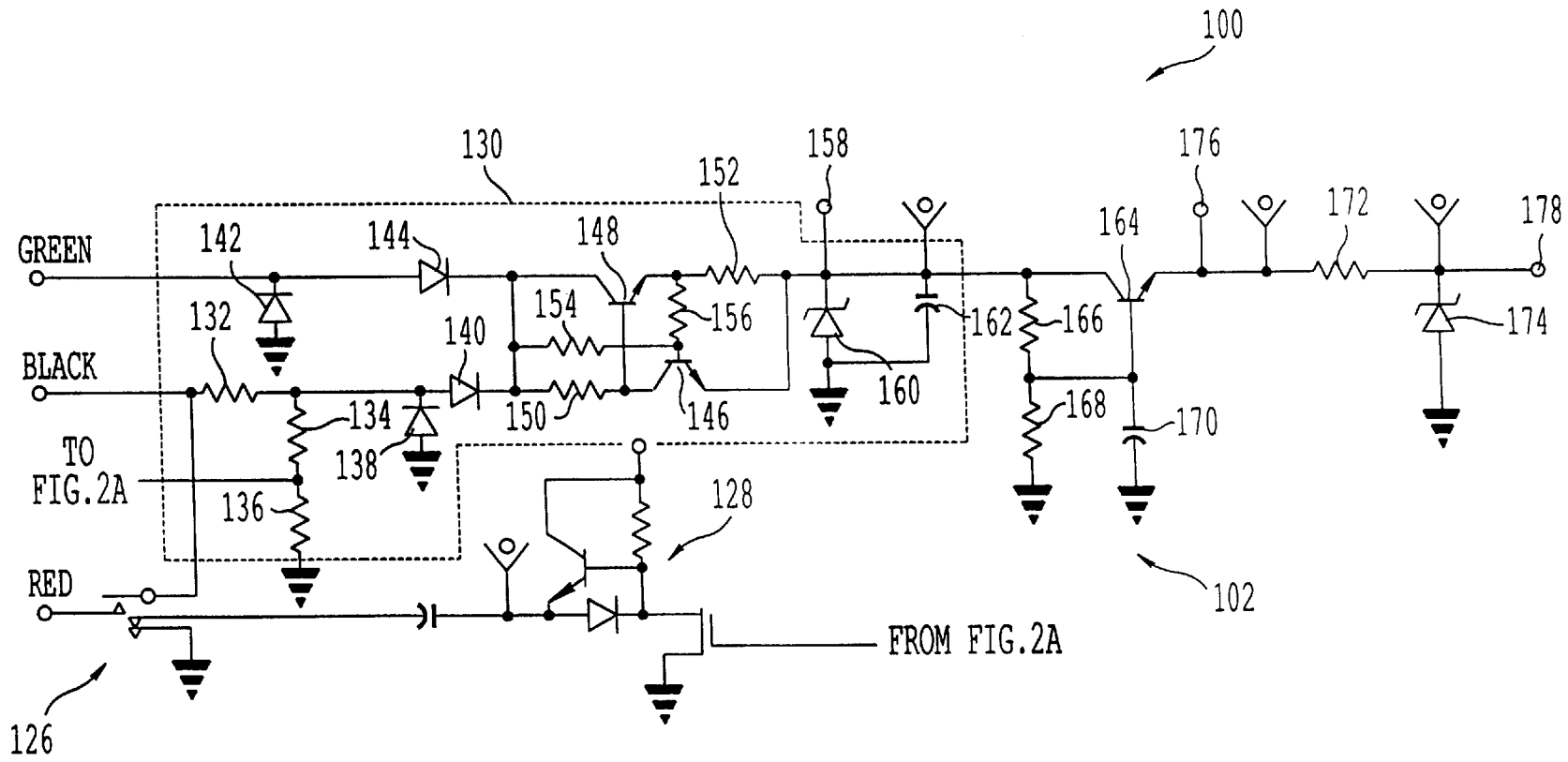

FIGS. 2A and 2B are schematic circuit diagrams of a motion sensor switch 100 having a DC power supply 102 for powering the motion sensor switch 100 employing an embodiment of the present invention. In this example, the motion sensor switch 100 controls activation and deactivation of a lighting circuit (not shown). The motion sensor switch 100 includes a motion sensor circuit 104 which includes a motion sensor 106, such as a passive infrared detector (PIR), and an ambient light level sensor circuit 108, which includes, for example, a photocell 110. The motion sensor 106 has a terminal 106-1 connected to circuit ground, the significance of which is described below. The motion sensor switch 100 also includes a controller 112, which analyzes signals received from the motion sensor circuit 104 and ambient light level sensor circuit 108 to determine whether the lighting circuit should be placed in an active or inactive state. Further details of the motion sensor switch 100 are described in U.S. Pat. No. 5,821,642 to Nishihira et al., cited above.

As discussed in the background section above, the motion sensor 106 detects changes in infrared energy radiating from regions of a monitored area, such as an office, conference room in a building, or a home, to detect the presence of an object of interest, such as a person. Motion sensor switch 100 further includes a motion sensitivity adjustment circuit 114, which includes an adjustable device 116, such as a potentiometer or the like, that can be adjusted to control the sensitivity at which the controller 112 responds to signals provided by the motion sensor circuit 104 as can be appreciated by one skilled in the art. Specifically, motion sensitivity adjustment circuit 114 can be adjusted to set a reference input to the controller 112 to which the controller compares the signal provided from the motion sensor circuit 104 to determine whether the signal indicates that the amount of detected motion is sufficient to warrant action by the controller 112.

The ambient light level sensor 110 detects the level of ambient light in the monitored area, and in response, the ambient light level sensor circuit 108 outputs a signal indicating whether the ambient light level is above or below a threshold level. An ambient light sensitivity adjustment circuit 118 includes an adjustable device 120, such as a potentiometer or the like, that can be adjusted to control the sensitivity at which the controller 112 responds to signals provided by the ambient light level sensor circuit 108 as can be appreciated by one skilled in the art. Specifically, sensitivity adjustment circuit 118 can be adjusted to set a reference input to the controller 112 to which the controller compares the signal provided from the ambient light level sensor circuit 108 to determine whether the signal indicates that the ambient light is sufficient to warrant action by the controller 112.

Motion sensor switch 100 also includes a time delay and bypass circuit 122 including a timing adjustment device 124, such as a potentiometer, which can be manually adjusted to set the delay time during which the lights servicing the monitored area should remain on after all occupants have left the monitored area. The timing adjustment device 124 can also be used to provide bypass on and bypass off conditions for the motion sensor switch 110, in which the motion sensor switch 100 maintains the lighting circuit in an active or inactive condition, respectively, regardless of the detection by motion sensor 106 and ambient light sensor 110. Details of the timing adjustment device 124 are described in U.S. patent application of Thomas S. Nishihira and David A. Blau entitled "Apparatus and Method for Providing Bypass Functions for a Motion Sensor Switch", Ser. No. 09/340,150, cited above.

As described in U.S. Pat. No. 5,821,642 to Nishihira et al., cited above, the motion sensor switch 100 further includes a relay 126 (see FIG. 2B) which is controlled by controller 112 to activate or deactivate the lighting circuit. A hot lead (the "black" lead) from an AC voltage power source (not shown) is applied to a terminal of the relay 126, and a lead (the "red" lead) of the lighting circuit (not shown) is coupled to another lead of the relay 126. The magnitude of the AC voltage applied to the relay terminal is typically 110 VAC or 277 VAC, but can be any magnitude suitable for driving the lighting circuit.

As long as the monitored area remains vacant, the motion sensor circuit 104 outputs a signal to the controller 112 indicative of this condition. The controller 112 interprets this signal as an indication that the monitored area is vacant, and outputs an appropriate signal to a relay driving circuit 128, the details of which are decried in U.S. Pat. No. 5,821,642 to Nishihira et al., cited above. The output of relay driving circuit 128 is coupled to the coil of relay 126 to control the relay of the lighting circuit to maintain the lights in the monitored area in an inactive or "off" state. That is, the signal maintains the relay 126 in an open condition in which the AC voltage is not supplied to the lighting circuit.

When a person enters the monitored area, the motion sensor 106 detects the change in infrared energy being emitted from the monitored area due to the presence of the person, and the motion sensor circuit 104 changes the status of the signal being output to the microprocessor 112. The controller 112 interprets this change in status as an indication that the monitored area has become occupied. The controller 112 then interprets the signal provided by the ambient light level sensor circuit 108 to determine whether it is appropriate to turn on the lights servicing the monitored area.

If the motion sensor switch 100 is not operating in a bypass mode, which is described in more detail in U.S. patent application of Thomas S. Nishihira and David A. Blau entitled "Apparatus and Method for Providing Bypass Functions for a Motion Sensor Switch", Ser. No. 09/340,150, cited above, the signal output by the controller 112 based on the interpretation of the signals provided by motion sensor circuit 104 and ambient light level sensor circuit 108 controls the output of the relay driving circuit 128 provided to the relay 126. That is, if the signal provided by ambient light level sensor circuit 108 indicates that the ambient light in the monitored area is sufficient (e.g., due to sunlight, etc.) and motion has been detected, the controller 112 controls the relay driving circuit 128 to control relay 126 to maintain the lights in the monitored area in an inactive or "off" state. However, if the signal provided by ambient light level sensor circuit 108 indicates that the ambient light in the monitored area is insufficient and motion has been detected, the controller 112 controls the relay driving circuit 128 to drive the relay 126 to provide the AC supply power to the lighting circuit to activate or "turn on" the lights in the monitored area.

As stated above, the motion sensor switch 100 receives power from a power supply 102 as shown in FIG. 2B. The power supply 102 includes a regulator 130 according to an embodiment of the present invention as will now be described.

The regulator 130 includes a 100 kΩ resistor 132 having a first terminal coupled to receive the AC voltage from the AC voltage source. The second terminal of resistor 132 is connected to a first terminal of a 10 MΩ resistor 134. The second terminal of resistor 134 is coupled to a port of controller 112 (see FIG. 2A) as shown, and is further coupled to a first terminal of a 1 MΩ resistor 136. The second terminal of resistor 136 is coupled to ground.

The regulator 130 further includes diodes 138, 140, 142 and 144, which are arranged as a full-wave rectifier circuit. The second terminal of resistor 132 is coupled to the cathode of diode 138, and to an anode of diode 140. The anode of diode 138 is coupled to ground, and the cathode of diode 140 is further coupled to the cathode of diode 144. The anode of diode 144 is coupled to the cathode of diode 142, and is further coupled to earth ground (the "green" lead). The anode of diode 142 is coupled to ground.

The regulator 130 further includes a first transistor 146, a second transistor 148, a 5.1 MΩ resistor 150, a 1 kΩ resistor 152, a 10 MΩ resistor 154, and a 6.81 kM resistor 156. In this example, first and second transistors 146 and 148 are each NPN transistors. However, as can be appreciated by one skilled in the art, the regulator 130 can be configured transistors 146 and 148 being PNP transistors. The collector of first transistor 146 is coupled to the base of second transistor 148, and to a first terminal of resistor 150. The second terminal of resistor 150 is coupled to the cathodes of diodes 140 and 144, to the collector of second transistor 148, and to a first terminal of resistor 154. The second terminal of resistor 154 is coupled to the base of first transistor 146.

The emitter of first transistor 146 is coupled to a first terminal of resistor 152, which is coupled to a first output terminal 158 of the power supply 102. The second terminal of resistor 152 is coupled to the emitter of second transistor 148, and to a first terminal of resistor 156. The second terminal of resistor 156 is coupled to the base of first transistor 146.

Regulator 130 further includes a zener diode 160 having a cathode coupled to the first output terminal 158 and an anode coupled to ground. The regulator 130 also includes a capacitor 162 having a first terminal coupled to first output terminal 158 and a second terminal coupled to ground.

As can be appreciated by one skilled in the art, the rectifier circuit arrangement of diodes 138, 140, 142 and 144 converts the AC voltage being received at the first terminal of resistor 132 into a rectified DC voltage. The arrangement of first and second transistors 146 and 148, respectively, and the resistors 150, 152, 154 and 156 provide a +28 volt DC voltage at first output terminal 158.

As can be further appreciated by one skilled in the art, the arrangement of resistors 154 and 156 and, in particular, the magnitude of resistance of resistor 154 in relation to the magnitude of resistance of resistor 156, limits the current flowing to earth ground to a magnitude less than 500 $\mu$A for any magnitude of AC source voltage ranging from about +100 VAC to about +302 VAC. Accordingly, the voltage that appears at first output terminal 158 remains at +28 volt DC for any magnitude of AC source voltage within this range.

It is also noted that the magnitudes of resistance for the resistors and capacitor of regulator 130 are not limited to those shown in this example. However, to limit the leakage to ground current in the manner described above, the ratio of the magnitude of resistances for resistors 154 and 156 should be the same or substantially the same as that provided for the resistance magnitudes shown. In this example, the ratio of the resistance value of resistor 154 (10 MΩ) to the resistance value of resistor 156 (6.81 kΩ) is 10 MΩ/6.81 kΩ, or 1468.428. Hence, the resistance values for resistors 154 and 156 can be chosen from any practical range of resistance values, as long as the ratio between the resistance values is maintained.

Figure 1:
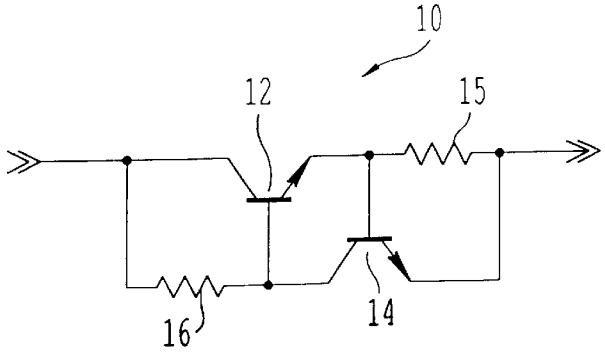
FIG. 1 (PRIOR ART)
FIG. 1 is a schematic circuit diagram of a conventional current regulator employed in a conventional DC power supply.
Figure 3:
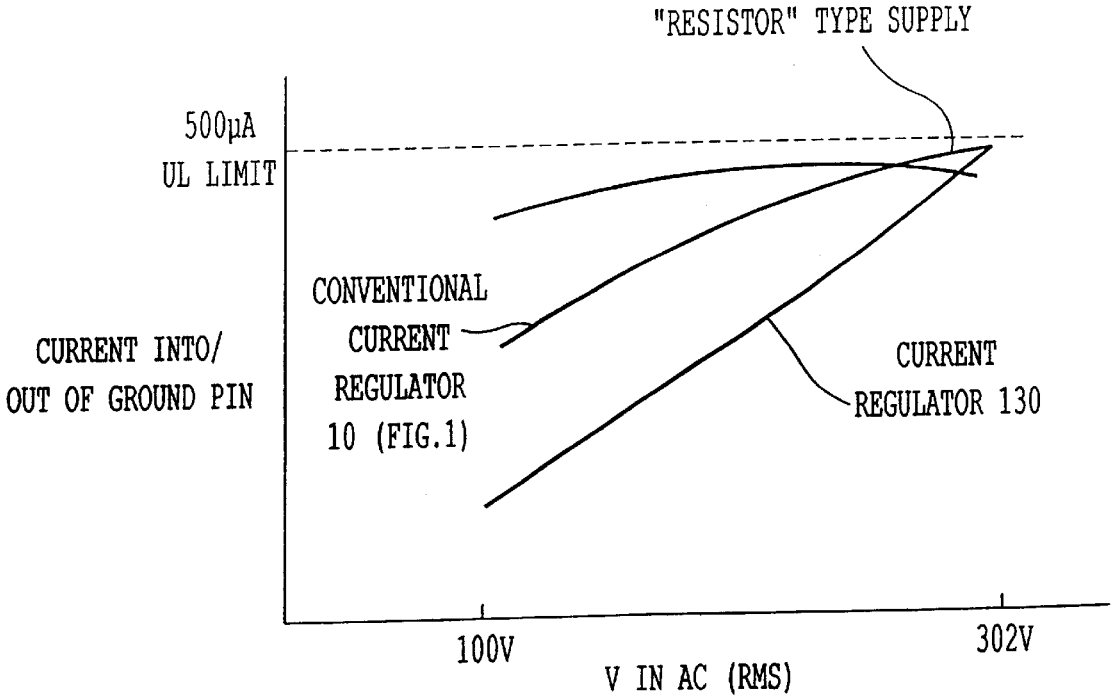
FIG. 3 is a graph illustrating exemplary relationships between the leakage to ground current and input supply voltage for a power supply circuit employing a regulator as shown in FIGS. 2A and 2B verses power supply circuits employing a regulator as shown in FIG. 1 and a resistor-type regulator.

The relationship between leakage to ground current of the power supply 102 employing the regulator 130 discussed above is shown in the graph of FIG. 3 for a range of AC source voltage between at or about +100 VAC and at or about +302 VAC RMS. The relationship between leakage to ground current versus source voltage for a power supply employing a conventional regulator 10 as shown in FIG. 1, as well as the relationship between leakage to ground current versus source voltage for a power supply employing a resistor as a regulator, are also shown. As indicated, the leakage to ground current of the power supply 102 employing regulator 130 remains substantially constant throughout the entire range of source voltages. On the contrary, the leakage to ground current for a power supply employing a conventional regulator 10 as shown in FIG. 1 or a resistor-type regulator varies substantially depending on the magnitude of the AC source voltage.

Accordingly, the stable +28 volt DC output at first output terminal 158 can be applied to the terminals of motion sensor switch 100 requiring a +28 volt DC input, as shown in FIG. 2A, in particular. Also, as shown in FIG. 2B, power supply 102 further includes a transistor 164, a 5.1 MO resistor 166, a 2.2 MO resistor 168, a capacitor 170, a 10 kΩ resistor 172, and a zener diode 174. As described in U.S. Pat. No. 5,821,642 to Nishihira et al., cited above, this arrangement provides a +6 volt DC output at second output terminal 176, and a +3 volt DC output at a third output terminal. Because these voltages are derived from the stable +28 volt DC output at first output terminal 158, these voltages are also stable. In other words, the regulator 130 enables the power supply 102 configured in this manner to provide stable +28, +6 and +3 DC voltages. These +6 volt and +3 volt outputs can be applied to the terminals of motion sensor switch 100 requiring these values, as shown in FIG. 2A. Also, as can be appreciated by one skilled in the art, the power supply 102 can include additional voltage divider circuitry coupled to the first output terminal 128 to provide additional output voltages at any desired value that can be derived from the +28 volt DC voltage at first output terminal 128.

Since the line voltage is essentially sinusoidal, the regulator 130 receives voltages between 0 and (304×√2) or approximately 540 volts. The optimal manner by which to obtain the maximum DC current (e.g., the current used by a motion sensor switch) for a given RMS current (e.g., the current defined to not exceed the aforementioned U.L. specification) is to maintain the instantaneous current being extracted as essentially constant at essentially all times. The regulator of the present invention embodies this principal to give a motion sensor switch, for example, the maximum current for operation.

Figure 4:
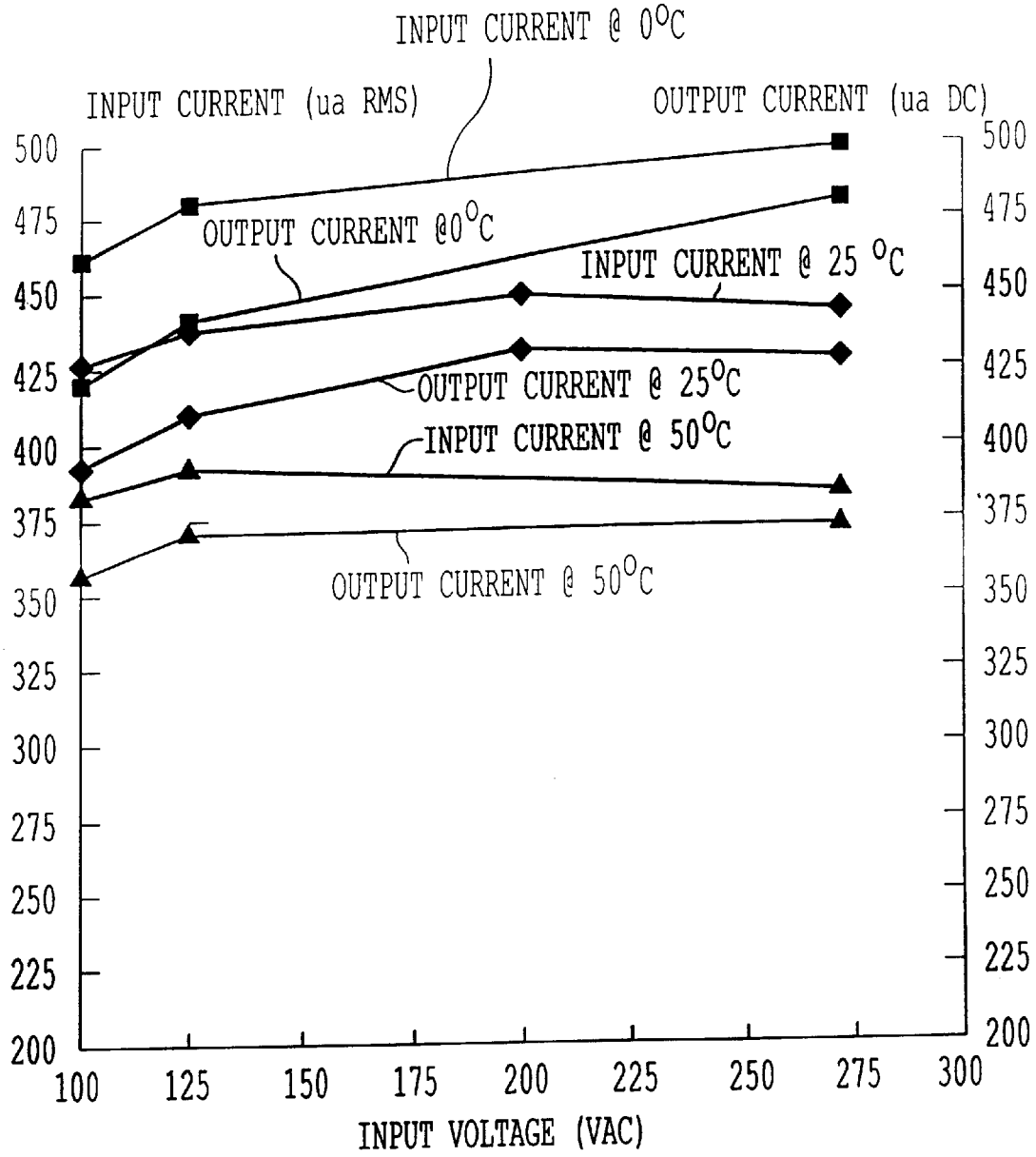
FIG. 4 is a graph illustrating exemplary relationships between the input current and output current for a DC power supply as shown in FIG. 2B at different temperatures.

The relationship between leakage to ground current of the power supply 102 employing the regulator 130 discussed above is shown in the graph of FIG. 4 and in Table 1 below for a range of AC source voltage between at or about +100 VAC and at or about +302 VAC RM, at temperatures of at or about 0° C., at or about 25° C., and at or about 50° C. As demonstrated, an essentially stable leakage to ground current is provided over the entire voltage range at each of the three different temperatures. Hence, a stable +28 volts D.C. is provided at terminal 158 of the regulator 130 (i.e., at the cathode of zener diode 160 of regulator 130).

TABLE 1

Exemplary Input vs. Output Currents For Regulator Circuit 130

| Input Voltage (VAC) | 100 | 120 | 200 | 270 |
|---|---|---|---|---|
| I In (μA rms) @ 0° C. | 461 | 479 | | 500 |
| I In (μA rms) @ 25° C. | 426 | 439 | 449 | 445 |
| I In (μA rms) @ 50° C. | 383 | 392 | | 386 |
| I Out (μA DC) @ 0° C. | 420 | 443 | | 482 |
| I Out (μA DC) @ 25° C. | 392 | 410 | 432 | 430 |
| I Out (μA DC) @ 50° C. | 358 | 370 | | 375 |

Figure 5:
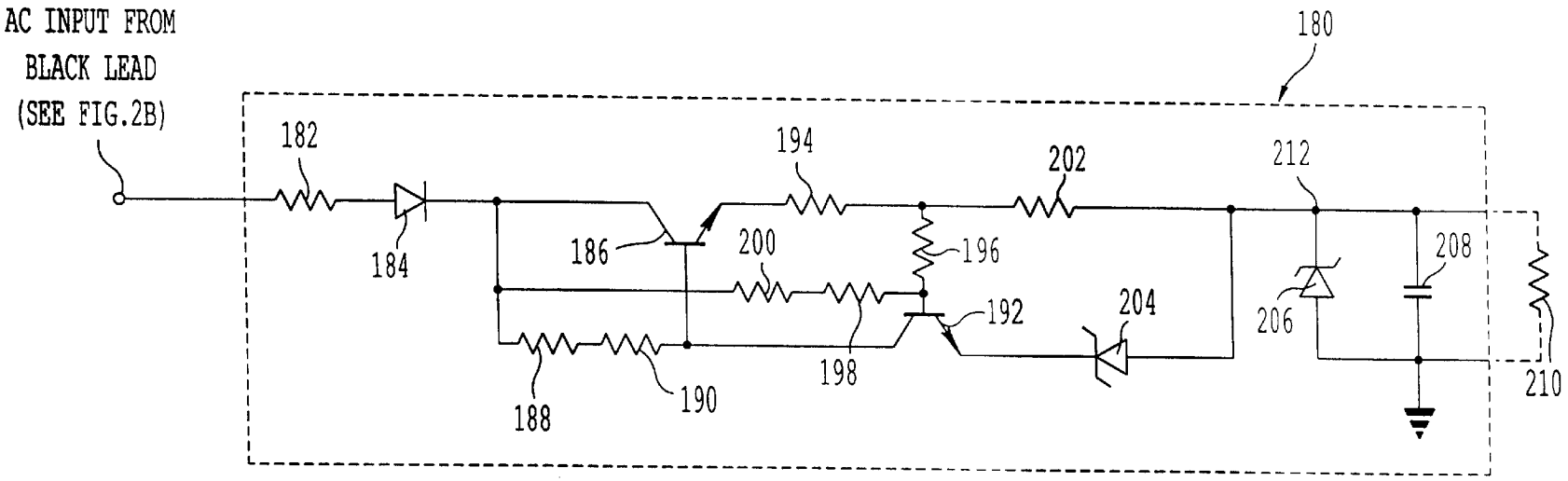
FIG. 5 is a schematic circuit diagram of a regulator according to another embodiment of the present invention that can be employed in the DC power supply shown in FIG. 2B.

However, as can be appreciated from the above, it is apparent that the ranges of values of the input and output (leakage) currents varies with temperature. Therefore, instead of employing regulator 130, power supply 102 can alternatively employ a regulator 180 as shown in FIG. 5. As demonstrated below, the arrangement of regulator 180 causes the stable leakage to ground current of power supply 102 to be less susceptible to fluctuations caused by changes in temperature.

Figure 8:
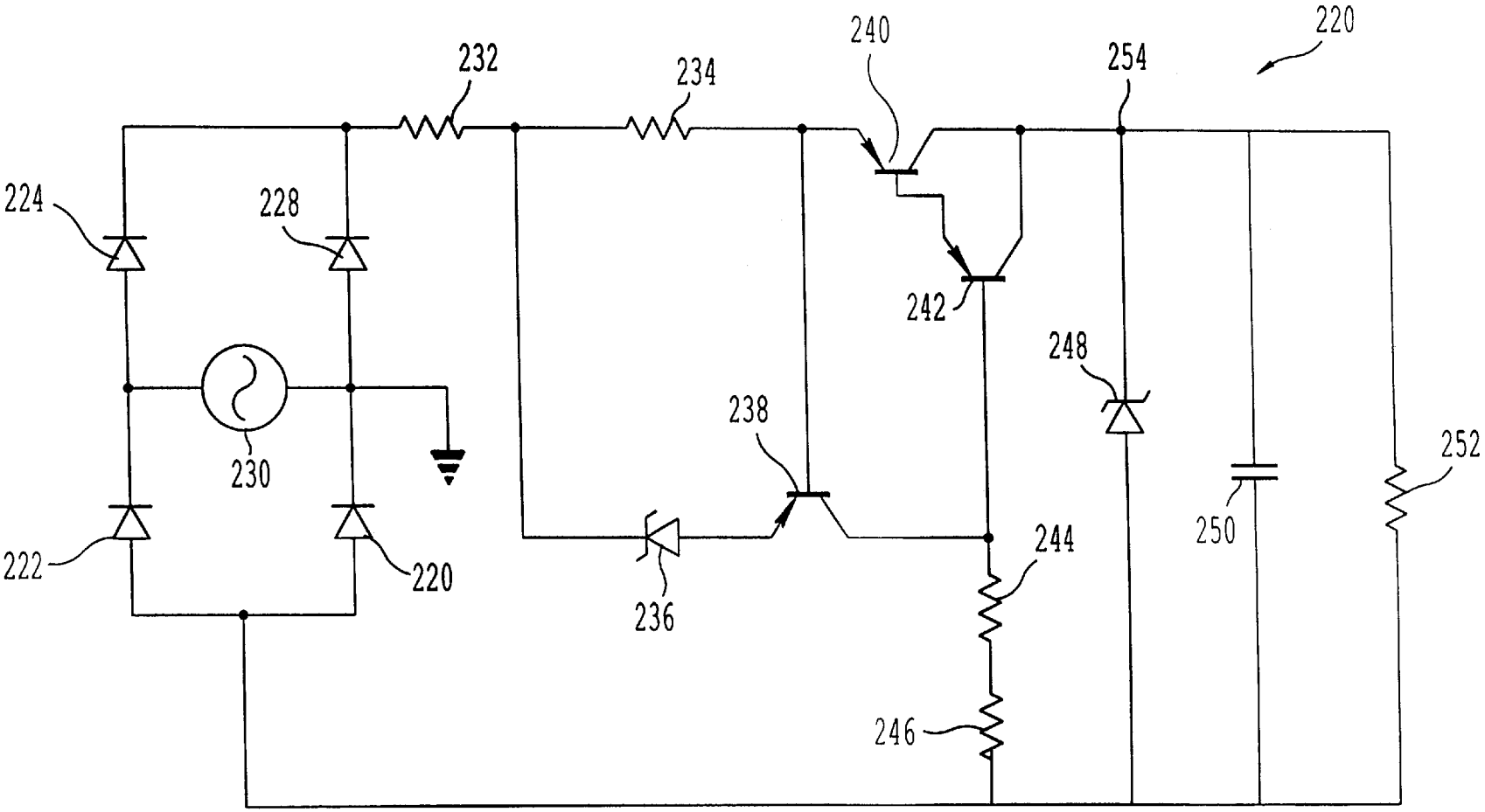
FIG. 8 is a schematic diagram of a regulator according to a further embodiment of the present invention that can be employed in the DC power supply shown in FIG. 2B.

As shown, regulator 180 includes a 100 kΩ resistor 182 having a terminal that is coupled to the AC power supply (the "black" line) in a manner similar to resistor 132 of regulator 130 as discussed above with regard to FIG. 2B. The other terminal of resistor 182 is coupled to the anode of a diode 184 which, as can be appreciated by one skilled in the art, functions as a half-wave rectifier. The cathode of diode 184 is coupled to the collector of an NPN transistor 186, and to a first terminal of a 1.2 MΩ resistor 188. The base of transistor 186 is coupled to a first terminal of another 1.2 MΩ resistor 190, and to the collector of an NPN transistor 192. The second terminal of resistor 190 is coupled to the second terminal of resistor 188 as shown. Although in this example, resistors 188 and 190 each have a resistance value of 1.2 MΩ, resistors 188 and 190 alternatively can be combined into a single high-voltage resistor having a resistance value of 2.4 MΩ or any other suitable value. Also, although transistors 186 and 192 are shown as NPN transistors, PNP transistors could be used in a configuration as shown in FIG. 8 as discussed below, and the resistance values in the circuit can be adjusted accordingly.

As further illustrated in FIG. 5, the emitter of transistor 186 is coupled to the first terminal of a 2.7 kΩ resistor 194. The second terminal of resistor 194 is coupled to the first terminal of an 100 kΩ resistor 196. The second terminal of resistor 196 is coupled to the base of transistor 192. Also, although resistor 196 in this example has a resistance value of 100 kΩ, resistor 196 can have a resistance value of 82 kΩ or any other suitable value.

The base of transistor 192 is further coupled to the first terminal of a 5.1 MΩ resistor 198, while the second terminal of resistor 198 is coupled to the first terminal of a 5.1 MΩ resistor 200. The second terminal of resistor 200 is coupled to the first terminal of resistor 188 and to the cathode of diode 184 as shown. In this example, two 5.1 MΩ resistors 198 and 200 coupled in series are used instead of a single 10 MΩ resistor to provide a larger voltage rating for the circuit. That is, because two standard 5.1 MΩ surface mount technology (SMT) resistors in series provide twice the maximum rated voltage of a single 10 MΩ SMT resistor.

As further illustrated, the first terminal of resistor 196 is coupled to the first terminal of a 7.5 kΩ resistor 202. The second terminal of resistor 202 is coupled to the anode of a zener diode 204 which, in this example, is a 5.6 volt zener diode. The cathode of zener diode 204 is coupled to the emitter of transistor 192 for purposes described below. Also, although resistor 202 in this example has a resistance value of 7.5 kΩ, resistor can alternatively have a resistance value of 8.2 kΩ or any other suitable value. The anode of zener diode 204 and the second terminal of resistor 202 are further coupled to the cathode of zener diode 206 which, in this example, is a 15 volt zener diode. The anode of zener diode 204 is coupled to earth ground, and a capacitor 208 is coupled in parallel to zener diode 204 as shown. It is further noted that in this example, all resistors except the 100 kΩ resistor 182 are SMT resistors. Resistor 182 in this example is a carbon compound resistor that is capable of handling large energy surges without damage. Naturally, the resistors can be made of any suitable material as can be appreciated by one skilled in the art.

As can be appreciated by one skilled in the art, the impedance provided by the circuit shown in FIG. 2A plus the voltage divider circuitry shown in FIG. 2B, that is, transistor 164, resistors 166, 168 and 172, capacitor 170, and zener diode 174, can be simulated as a 100 kΩ resistor 210 as shown in FIG. 5. Also, it is noted that zener diode 206 in this embodiment has a rating of 15 volts, as compared with the 28 volt rating of zener diode 160 in the regulator circuit 130 shown in FIG. 2B. Accordingly, as can be appreciated by one skilled in the art, the values of resistors 166, 168 and 172, capacitor 170, and zener diode 174 can be modified as appropriate so that the regulator circuit 180 can provide a stable +6 volt D.C. voltage at terminal 176, and a stable +3 volt D.C. voltage at terminal 178. Alternatively, the 15 volt zener diode 206 can be replaced with a 28 volt zener diode similar to diode 160 shown in FIG. 2B, or with a zener diode having any suitable voltage rating.

It is noted that resistors 196, 198 and 200 function in a manner similar to resistors 154 and 156 in regulator 130 to compensate for variations in the A.C. input voltage as described above. Furthermore, diode 204 provides approximately +2 mV/° C. compensation for the −2 mV/° C. thermal change in the base-emitter voltage $V_{be}$ voltage of transistor 192 that occurs with a change in temperature ambient to regulator 180. In addition, resistor 194 allows for an additional voltage drop between the emitters of transistors 186 and 192, so that the voltage across resistor 202 can drop sufficiently to compensate for an increase in A.C. input voltage.

The relationship between leakage to ground current of the power supply 102 employing the regulator 180 discussed above is shown in the graph of FIG. 6 and in Table 2 below for a range of AC source voltage between at or about 100 VAC and at or about 270 VAC RM, at temperatures of at or about 0° C., at or about 25° C., and at or about 50° C. As demonstrated, an essentially stable leakage to ground current is provided over the entire voltage range at the three different temperatures. Hence, a stable +15 volts D.C. is provided at terminal 212 of the regulator 180 (i.e., at the cathode of zener diode 206 of regulator 180).

TABLE 2

Exemplary Input vs. Output Currents For Regulator Circuit 180

| Input Voltage (VAC) | 100 | 120 | 200 | 270 |
|---|---|---|---|---|
| I In (μA rms) @ 0° C. | 371 | 388 | | 376 |
| I In (μA rms) @ 25° C. | 376 | 393 | 390 | 377 |

TABLE 2-continued

| Exemplary Input vs. Output Currents For Regulator Circuit 180 | | | | |
|---|---|---|---|---|
| I In (μA rms) @ 50° C. | 375 | 390 | | 378 |
| I Out (μA DC) @ 0° C. | 239 | 254 | | 260 |
| I Out (μA DC) @ 25° C. | 241 | 257 | 267 | 260 |
| I Out (μA DC) @ 50° C. | 241 | 256 | | 261 |

Figure 6:
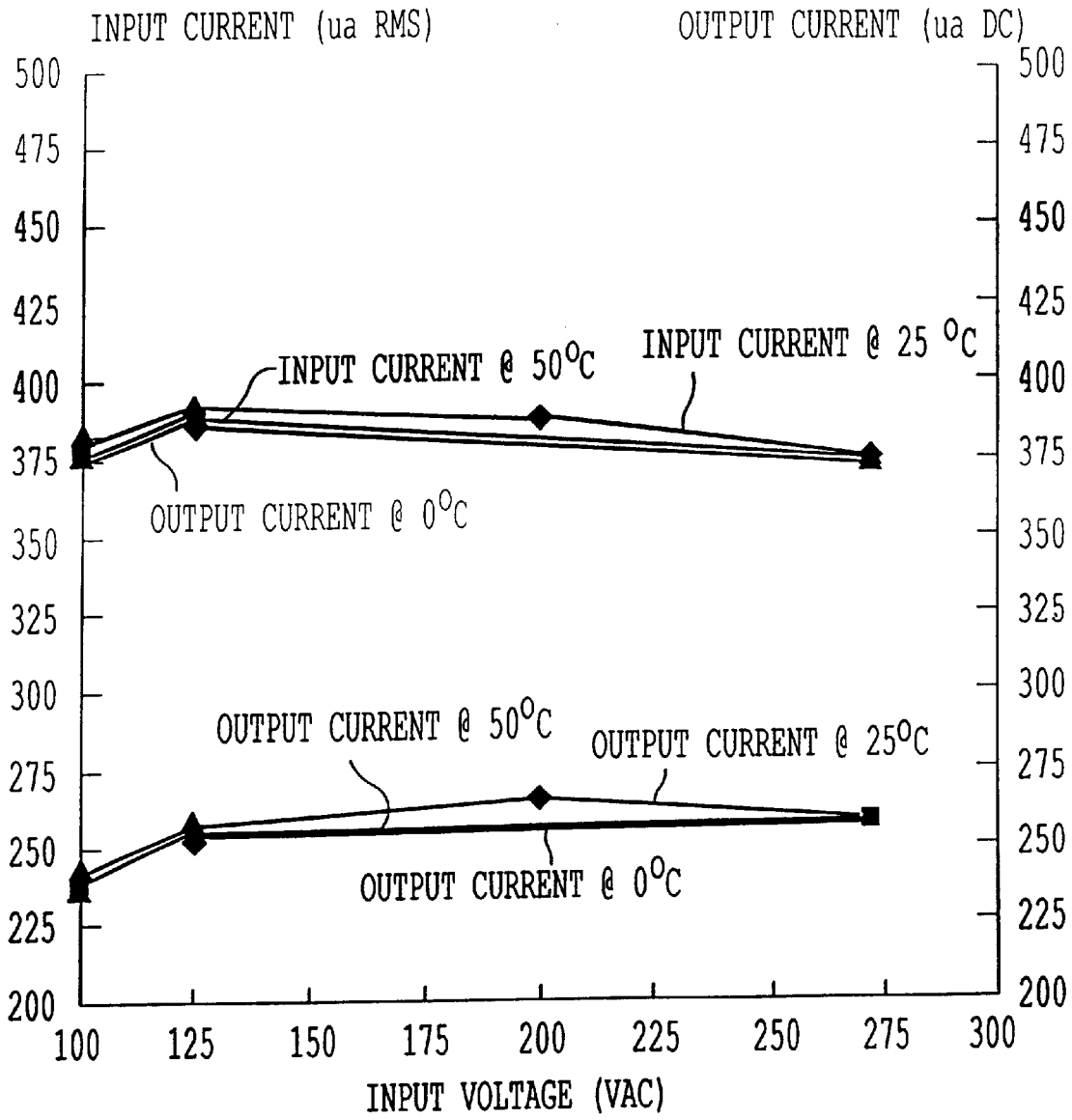
FIG. 6 is a graph illustrating exemplary relationships between the input current and output current at different temperatures for a power supply circuit as shown in FIG. 2B including a regulator as shown in FIG. 5.

Accordingly, it can be appreciated from the above Table 2 and the graph shown in FIG. 6 that the input current variation experienced by regulator 180 for an input voltage variation from 100 VAC to 270 VAC over a temperature variation from 0° C. to 50° C. is about 22 μA rms. It is noted that in contrast, the input current variation experienced by regulator 130 for the same, voltage variations over the same temperature variations is about 117 μA rms. As can be further appreciated from the above Table 2 and graph shown in FIG. 6, the output current variation experienced by regulator 180 for an input voltage variation from 100 VAC to 270 VAC over a temperature variation from 0° C. to 50° C. is about 28 μA DC. It is noted that in contrast, the output current variation experienced by regulator 130 (see Table 1) for the same voltage variations over the same temperature variations is about 124 μA rms.

Because regulator 180 employs a half-wave rectifier (diode 184 shown in FIG. 5), the peak voltage between the terminal 106-1 of sensor 106 (see FIG. 2A) and the earth ground (green lead in FIG. 2B) is limited to a peak voltage of at or about 14 volts for an input voltage of 277 VAC . This voltage limitation therefore eliminates the possibility for even a minor electric shock to occur if, for example, a person's finger comes into contact with the metal case of sensor 106 while the person is in contact with earth ground. On the contrary, the regulator 130 employing the full-wave rectifier allows for a current-limited peak voltage of at or about 320 volts relative to earth ground to be present at terminal 106-1 of sensor 106 during the negative half of the input voltage cycle for an input voltage of 277 VAC. Accordingly, when the power supply 102 employs regulator 130, other safeguards can be used to minimize the chances for electrical shock to occur at sensor 106, such as a finger guard or current limiting circuit as described in a U.S. patent application of Thomas J. Batko, Ser. No. 09/141,590, the entire contents of which are incorporated herein by reference.

Figure 7:
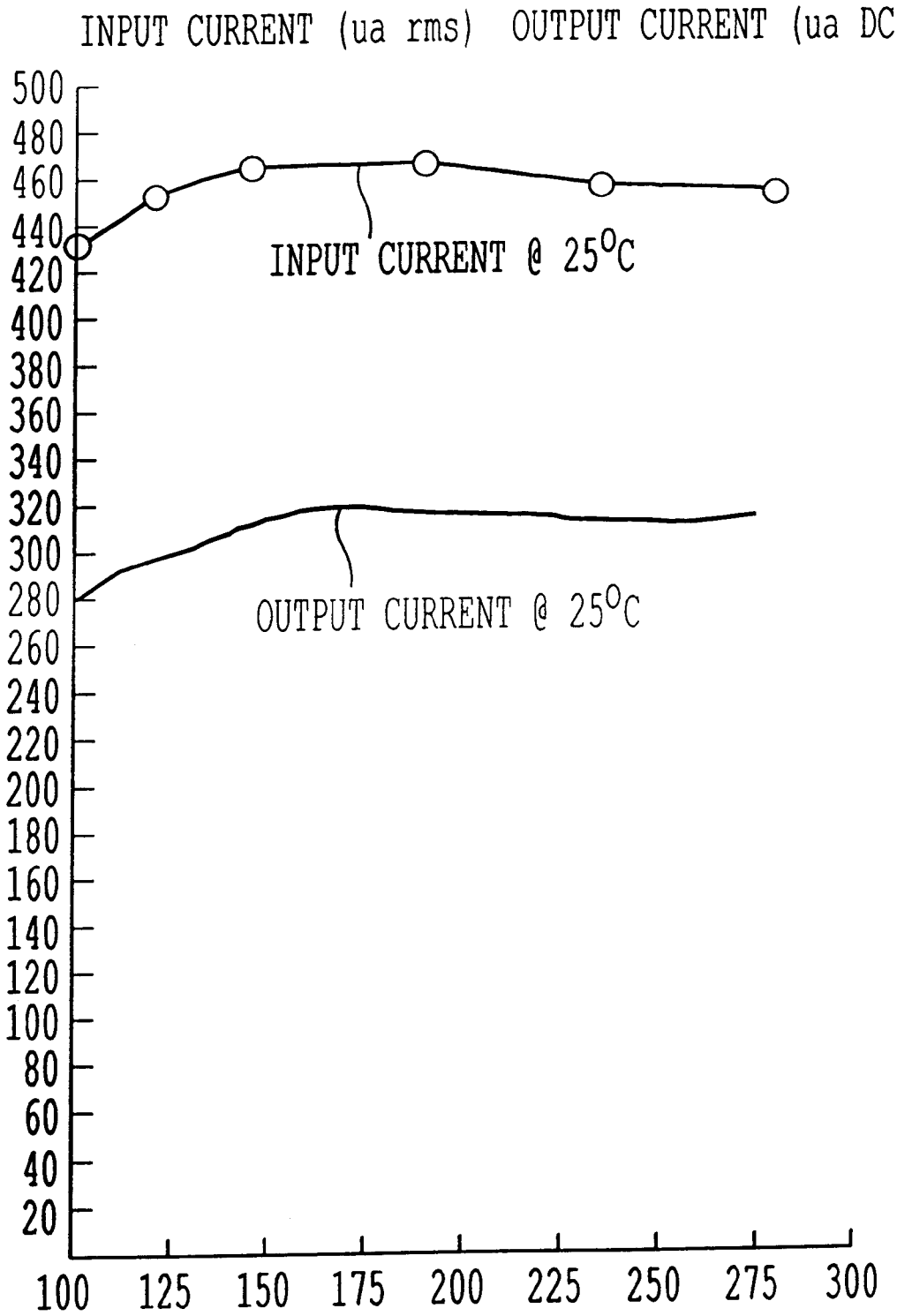
FIG. 7 is a graph illustrating exemplary relationships between the input current and output current at a constant temperature for a power supply circuit as shown in FIG. 2B including a regulator as shown in FIG. 5.

It is further noted that the circuit described above provides for a stable output current over the range of input voltages irrespective of the magnitude of the input current to the regulator 180. For example, as shown in the graph of FIG. 7, the input current fluctuates between about 431 μA rms and 466 μA rms for the input voltage range of 100 VAC to 280 VAC at a temperature of 25° C. The output current remains roughly stable between about 276 μA DC and about 319 μA DC for this input voltage range.

Instead of employing regulators 130 or 180 as discussed above, power supply 102 can alternatively employ a regulator 220 as shown in FIG. 8. Like regulator 130 discussed above, regulator 220 includes diodes 222, 224, 226 and 228, which are arranged as a full wave rectifier circuit. The input voltage which, in this example, is represented by voltage source 230, is coupled to diodes 222, 224, 226 and 228. Specifically, when regulator 220 is employed in the power supply 102 shown in FIG. 2B, the hot lead (i.e., the "black" lead) is coupled to the cathode of diode 222 and to the anode of diode 224, and the earth ground lead (i.e., the "green" lead) is coupled to the cathode of diode 220 and to the anode of diode 228.

As further illustrated, regulator 220 includes a 100 kΩ resistor 232 having a first terminal coupled to the cathodes of diodes 224 and 228. The second terminal of resistor 232 is coupled to the first terminal of resistor 234, and to the cathode of a zener diode circuit 236. The second terminal of resistor 234 is coupled to the base of PNP transistor 238 and to the emitter of PNP transistor 240, and the emitter of PNP transistor 238 is coupled to the anode of zener diode circuit 236.

The base of transistor 240 is coupled to the emitter of PNP transistor 242, and the base of PNP transistor 242 is coupled to the collector of PNP transistor 238 and to the first terminal of a resistor 244. The second terminal of resistor 244 is coupled to the first terminal of resistor 246, and the second terminal of resistor 246 is coupled to the anodes of diodes 220 and 220, and to the anode of zener diode 248 The collectors of PNP transistors 240 and 242 are coupled together, and to the cathode of zener diode 248. As can be appreciated by one skilled in the art, the circuit can be modified so that any or all of transistors 238, 240 and 242 are NPN transistors, and the resistance values can be adjusted accordingly.

A capacitor 250 is coupled in parallel to zener diode 248 as shown. The impedance provided by the circuit in FIG. 2A plus the voltage divider circuitry shown in FIG. 2B, that is, by transistor 164, resistors 166, 168 and 172, capacitor 170, and zener diode 174, can be simulated by, for example, a 100 kΩ resistor 252. Accordingly, because zener diode 248 is a 15 V zener diode, the regulator 220 provides at its output terminal 254 (the cathode of zener diode 248) a stable output voltage of 15 volts, with an output leakage to ground current whose magnitude is essentially unaffected by changes in the magnitude of voltage input into regulator 220 or by changes in ambient temperature as described above with regard to regulator 180.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. An apparatus for regulating a DC power supply, said DC power supply being adaptable for use with a motion sensor switch and having a power supply input terminal adapted to receive a source AC voltage, at least one power supply output terminal adapted to output at least one DC output voltage, and a ground terminal, said DC power supply generating in response to said source AC voltage a leakage current flowing to said ground terminal, said apparatus comprising:

an input terminal, adapted to receive an AC voltage based on said source AC voltage; and a regulator, coupled to said input terminal to receive said AC voltage, and being adapted to limit said leakage current to a predetermined magnitude, to maintain said predetermined magnitude of said leakage current substantially constant in response to a variation in said input AC voltage within an AC voltage range, and to output a DC voltage having a magnitude which remains substantially constant in response to variations in said input AC voltage, said power supply outputting said at least one DC output voltage based on said DC voltage, and wherein:

said regulator is further adapted to maintain said predetermined magnitude of said leakage current substantially constant in response to a variation in temperature of at least a portion of said regulator.

2. An apparatus for regulating a DC power supply, said DC power supply being adaptable for use with a motion sensor switch and having a power supply input terminal adapted to receive a source AC voltage, at least one power supply output terminal adapted to output at least one DC output voltage, and a ground terminal, said DC power supply generating in response to said source AC voltage a leakage current flowing to said ground terminal, said apparatus comprising:

an input terminal, adapted to receive an AC voltage based on said source AC voltage; and a regulator, coupled to said input terminal to receive said AC voltage, and being adapted to limit said leakage current to a predetermined magnitude, to maintain said predetermined magnitude of said leakage current substantially constant in response to a variation in said input AC voltage within an AC voltage range, and to output a DC voltage having a magnitude which remains substantially constant in response to variations in said input AC voltage, said power supply outputting said at least one DC output voltage based on said DC voltage, and wherein:

said regulator limits and maintains said leakage current to said predetermined magnitude which is less than or equal to 500 $\mu$A.

3. An apparatus for regulating a DC power supply, said DC power supply being adaptable for use with a motion sensor switch and having a power supply input terminal adapted to receive a source AC voltage, at least one power supply output terminal adapted to output at least one DC output voltage, and a ground terminal, said DC power supply generating in response to said source AC voltage a leakage current flowing to said ground terminal, said apparatus comprising:

an input terminal, adapted to receive an AC voltage based on said source AC voltage; and a regulator, coupled to said input terminal to receive said AC voltage, and being adapted to limit said leakage current to a predetermined magnitude, to maintain said predetermined magnitude of said leakage current substantially constant in response to a variation in said input AC voltage within an AC voltage range, and to output a DC voltage having a magnitude which remains substantially constant in response to variations in said input AC voltage, said power supply outputting said at least one DC output voltage based on said DC voltage, and wherein said regulator comprises:

first and second transistors; and first and second resistance elements;

the base and collector of said first transistor and the base and collector of said second transistor being adapted to receive respective voltages based on said AC voltage, and the emitter of said first transistor being adapted to output said DC voltage; and said first resistance element having a first terminal coupled to said input terminal and a second terminal coupled to the base of said first transistor, and said second resistance element having a first terminal coupled to the base of said first transistor and a second terminal coupled to the emitter of said second transistor.

4. An apparatus as claimed in claim 3, wherein said regulator further comprises:

a zener diode, coupled between the emitters of said first and second transistors, and being adapted to cause said regulator to maintain said leakage current substantially constant in response to a change in temperature of said regulator.

5. An apparatus as claimed in claim 3, wherein:

said first resistance element has a resistance value in relation to a resistance value of said second resistance element which causes said regulator to limit and maintain said leakage current to said predetermined magnitude which is less than or equal to 500 $\mu$A.

6. An apparatus as claimed in claim 3, wherein:

said first resistance element is a 10 MΩ resistor and said second resistance element is a 6.81 kΩ resistor.

7. An apparatus as claimed in claim 3, wherein:

a ratio of a magnitude of resistance of said first resistance element and a magnitude of resistance of said second resistance element is about 1468.

8. An apparatus as claimed in claim 3, wherein:

said second terminal of said first resistance element is directly connected to said base of said first transistor.

9. An apparatus as claimed in claim 3, wherein:

said first and second terminals of said second resistance element are directly connected to the base of said first transistor and the emitter of said second transistor, respectively.

10. An apparatus as claimed in claim 3, wherein:

said first and second transistors are NPN transistors.

11. An apparatus as claimed in claim 3, wherein said regulator further comprises:

a third resistance element having a first terminal coupled to said input terminal of said regulator and a second terminal coupled to the collector of said first transistor and the base of said second transistor; and a fourth resistance element having a first terminal coupled to the emitter of said second transistor and a second terminal coupled to the emitter of said first transistor.

12. An apparatus as claimed in claim 3, wherein said regulator further comprises:

a rectifier, adapted to generate said first voltage based on said AC voltage.

13. An apparatus as claimed in claim 12, wherein:

said first and second terminals of said first resistance element are directly connected to an output terminal of said rectifier and said base of said first transistor, respectively.

14. A method for regulating a DC power supply, said DC power supply being adaptable for use with a motion sensor switch and having a power supply input terminal adapted to receive a source AC voltage, at least one power supply output terminal adapted to output at least one DC output voltage, and a ground terminal, said DC power supply generating in response to said source AC voltage a leakage current flowing to said ground terminal, said method comprising the steps of:

limiting said leakage current to a predetermined magnitude, and maintaining said predetermined magnitude of said leakage current substantially constant in response to variations in said source AC voltage within an AC voltage range;

generating a DC voltage based on said source AC voltage;

maintaining a magnitude of said DC voltage substantially constant in response to a variation in said source AC voltage within said AC voltage range; and maintaining said magnitude of said DC voltage substantially constant in response to a variation in temperature of at least a portion of said regulator.

15. A method for regulating a DC power supply, said DC power supply being adaptable for use with a motion sensor switch and having a power supply input terminal adapted to receive a source AC voltage, at least one power supply output terminal adapted to output at least one DC output voltage, and a ground terminal, said DC power supply generating in response to said source AC voltage a leakage current flowing to said ground terminal, said method comprising the steps of:

limiting said leakage current to a predetermined magnitude, and maintaining said predetermined magnitude of said leakage current substantially constant in response to variations in said source AC voltage within an AC voltage range;

generating a DC voltage based on said source AC voltage; and maintaining a magnitude of said DC voltage substantially constant in response to a variation in said source AC voltage within said AC voltage range, and wherein:

said leakage current limiting and maintaining step limits and maintains said leakage current to said predetermined magnitude which is less than or equal to 500 $\mu$A.

16. A method for regulating a DC power supply, said DC power supply being adaptable for use with a motion sensor switch and having a power supply input terminal adapted to receive a source AC voltage, at least one power supply output terminal adapted to output at least one DC output voltage, and a ground terminal, said DC power supply generating in response to said source AC voltage a leakage current flowing to said ground terminal, said method comprising the steps of:

limiting said leakage current to a predetermined magnitude, and maintaining said predetermined magnitude of said leakage current substantially constant in response to variations in said source AC voltage within an AC voltage range;

generating a DC voltage based on said source AC voltage;

maintaining a magnitude of said DC voltage substantially constant in response to a variation in said source AC voltage within said AC voltage range;

generating a plurality of said DC output voltages based on said DC voltage generated in said generating step; and maintaining a respective magnitude of each of said DC output voltages substantially constant in response to variations in said source AC voltage within said AC voltage range.

17. A motion sensor switch, comprising:

a motion sensor, adapted to sense a condition of a monitored area and output a signal indicative thereof; and a power supply, adapted to power said motion sensor, said power supply comprising:

a power supply input terminal adapted to receive a source AC voltage;

at least one power supply output terminal adapted to output at least one DC output voltage to said motion sensor;

a ground terminal adapted to receive a leakage current generated by said DC power supply in response to said source AC voltage; and a regulator, adapted to limit said leakage current to a predetermined magnitude, to maintain said predetermined magnitude of said leakage current substantially constant in response to a variation in said source AC voltage within an AC voltage range, and to output a DC voltage having a magnitude which remains substantially constant in response to a variation in said input AC voltage;

said power supply outputting said at least one DC output voltage based on said DC voltage.

18. A motion sensor switch as claimed in claim 17, wherein:

said regulator is further adapted to maintain said predetermined magnitude of said leakage current substantially constant in response to a variation in temperature of at least a portion of said regulator.

19. A motion sensor switch as claimed in claim 17, wherein:

said regulator limits and maintains said leakage current to said predetermined magnitude which is less than or equal to 500 $\mu$A.

20. A motion sensor switch as claimed in claim 17, wherein:

said power supply outputs three said DC output voltages of different magnitudes to said motion sensor.

21. A motion sensor switch as claimed in claim 17, wherein said regulator comprises:

first and second transistors; and first and second resistance elements;

the base and collector of said first transistor and the base and collector of said second transistor being adapted to receive respective voltages based on said source AC voltage, and the emitter of both said first and second transistors being adapted to output said DC voltage; and said first resistance element having a first terminal coupled to said input terminal and a second terminal coupled to the base of said first transistor, and said second resistance element having a first terminal coupled to the base of said first transistor and a second terminal coupled to the emitter of said second transistor.

22. A motion sensor switch as claimed in claim 21, wherein:

said first resistance element has a resistance value in relation to a resistance value of said second resistance element which causes said regulator to limit and maintain said leakage current to said predetermined magnitude which is less than or equal to 500 $\mu$A.

* * * * *